United States Patent [19]

Peterpaul et al.

[11] Patent Number: 4,582,984

[45] Date of Patent: Apr. 15, 1986

[54] WIRE MARKER PRINTER

[75] Inventors: Joseph Peterpaul, West Orange, N.J.; Paul J. Gazzara, Drexel Hill, Pa.

[73] Assignee: Thomas & Betts Corporation, Raritan, N.J.

[21] Appl. No.: 496,793

[22] Filed: May 23, 1983

[51] Int. Cl.[4] ..... G06C 29/00

[52] U.S. Cl. ..... 235/58 CF; 235/58 P; 235/145 R

[58] Field of Search ..... 235/58 CF, 58 P, 60 P, 235/145 R, 433, 101, 145 A, 146; 400/613, 615.1, 615.2, 621, 531; 364/200, 709, 900; 455/196

[56] References Cited

U.S. PATENT DOCUMENTS

| | | | |
|---|---|---|---|
| 2,971,628 | 2/1961 | Griffith | 400/615.1 |
| 3,571,655 | 3/1971 | Tanimoto | 340/760 |
| 3,571,808 | 2/1971 | Washizuka et al. | 364/200 |
| 3,834,616 | 9/1974 | Washizuka et al. | 364/709 |
| 3,902,169 | 8/1975 | Washizuka | 340/765 |
| 3,976,944 | 8/1976 | Kreuy et al. | 455/196 |
| 4,020,467 | 4/1977 | Hashimoto et al. | 364/900 |
| 4,030,094 | 6/1977 | Anderson | 235/145 R X |
| 4,119,839 | 10/1978 | Bechmann et al. | 235/145 R |
| 4,158,130 | 6/1979 | Speraus et al. | 235/145 R X |
| 4,326,193 | 4/1982 | Markley et al. | 235/145 R X |
| 4,472,625 | 9/1984 | Lemoine | 235/101 |

FOREIGN PATENT DOCUMENTS

| | | | |
|---|---|---|---|
| 380989 | 9/1932 | United Kingdom | 400/531 |

OTHER PUBLICATIONS

Sharp Electronic Printing Calculator Elsimate Model EL-1188S Instruction Manual.

*Primary Examiner*—Benjamin R. Fuller

*Attorney, Agent, or Firm*—Robert M. Rodrick; Salvatore J. Abbruzzese

[57] ABSTRACT

A wire marker printer is formed from a commercially available electronic calculator. The calculator having both computation and printing capabilities is modified to function as a wire marker printer. The computation capabilities are deactivated and the paper receiving chamber is modified to accept a roll of wire markers.

8 Claims, 8 Drawing Figures

WIRE MARKER PRINTER

FIELD OF THE INVENTION

This invention relates to a method of making indicia bearing wire markers and more particularly pertains to a method of making wire markers from an adapted electronic calculator.

BACKGROUND OF THE INVENTION

In many electronic and electrical applications, large numbers of wires, cables and leads are typically used to effect interconnections between various components. During the course of installation of these components, it is often necessary to frequently disconnect and reconnect more than one wire at a time. In order to prevent confusion and ultimate incorrect reconnection, it has been long known to mark or otherwise identify the wires to be disconnected to assist in correct reconnection.

Pre-printed wire markers are available which when applied to the wires provide unique identification for each individual wire. While this results in suitably marked wires, in situations where large numbers of wires need to be simultaneously identified, the user must have available many differently marked wire markers. Further, many uses require unique identification indicia not readily available on preprinted markers. To eliminate these problems, blank markers are available where the user prints or types different indicia on each marker. Handprinting, however, is not always desirable, as often the printing of one worker may be unintelligible to another worker. Further, hand-printing has a tendency to smudge, making identification difficult. Additionally, when marking wires in the range of AWG 14–18, the printed indicia would have to be relatively small to provide ease in identification. It would be difficult to hand print such small characters. Typing, on the other hand, while neat and permanent, requires a separate operation not usually available to a worker at the specific site.

SUMMARY OF THE INVENTION

It is therefore an object of the present invention to provide a method of making wire markers.

It is a further object to provide a method of modifying an electronic calculator to adapt it for use in printing wire markers.

In the efficient attainment of the foregoing and other objects, the present invention provides a method of adapting a commercially available electronic calculator for use as a wire marker printer. The calculator which has both computation and printing characteristics is adapted to function as a wire marker printer. The computation mechanism is rendered inoperative, thereby preventing calculations. Further, the paper accommodating chamber of the calculator is modified to accept a roll of wire markers.

Thus, indicia bearing wire markers are formed by inserting a roll of wire markers into the paper chamber of the calculator. The desired indicia is inputted into the calculator. The printer is then activated to print the desired indicia on the wire marker.

DETAILED DESCRIPTION OF THE PREFERRED EMBODIMENT

Figure 1:
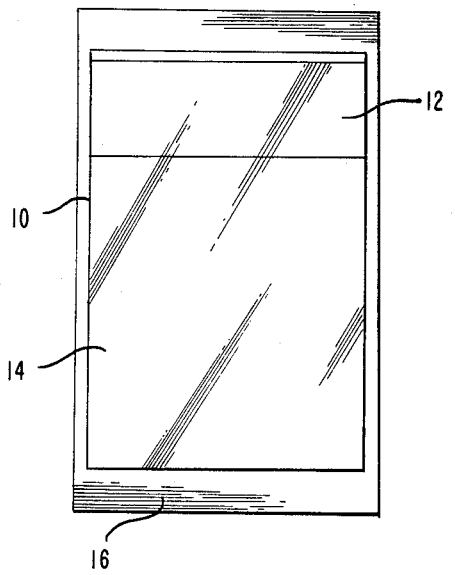
FIG. 1 shows a typical wire marker employed in the present invention.

FIG. 1 shows a typical wire marker 10, which is used to identify wires for electrical connection. Wire marker 10 is of the type known in the industry as a self-laminating marker having an indicia bearing portion 12 which is positioned adjacent the upper edge of an extending transparent vinyl portion 14. When wrapped around the wire (not shown), the vinyl portion 14 covers the indicia bearing portion 12 thus preventing smearing of the printing. One side of the transparent vinyl portion 14 has adhesive thereon to enable the marker 10 to adhere to the wire. Prior to marking and placement on the wire, the marker 10 is usually backed with a release liner 16 to protect the adhesive. While a self-laminating marker 10 is shown, as will become apparent from the following description, the present invention may be used in connection with standard indicia bearing wire markers which may not be of the self-laminating type.

Figure 2:
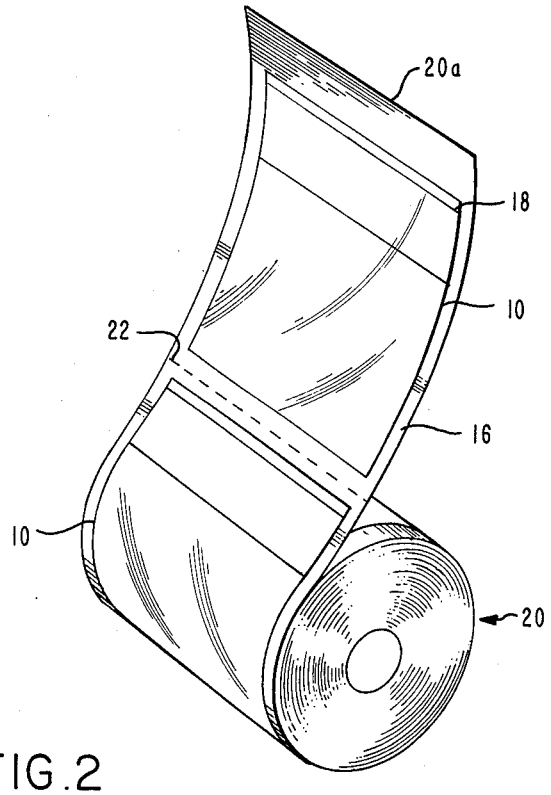
FIG. 2 shows a roll of wire markers of FIG. 1 formed for use with the present invention.

In order to provide the wire marker 10 in a suitable form for use with the printer described herein, the markers as shown in FIG. 2 are provided on a continuous roll 20 of release material 16 and may have a tab portion 18 which extends beyond the edge of indicia-bearing portion 12 of wire marker 10. To facilitate use as individual markers, the roll 20 may be perforated at 22 between each marker 10, thus providing for ease of separation.

Figure 3:
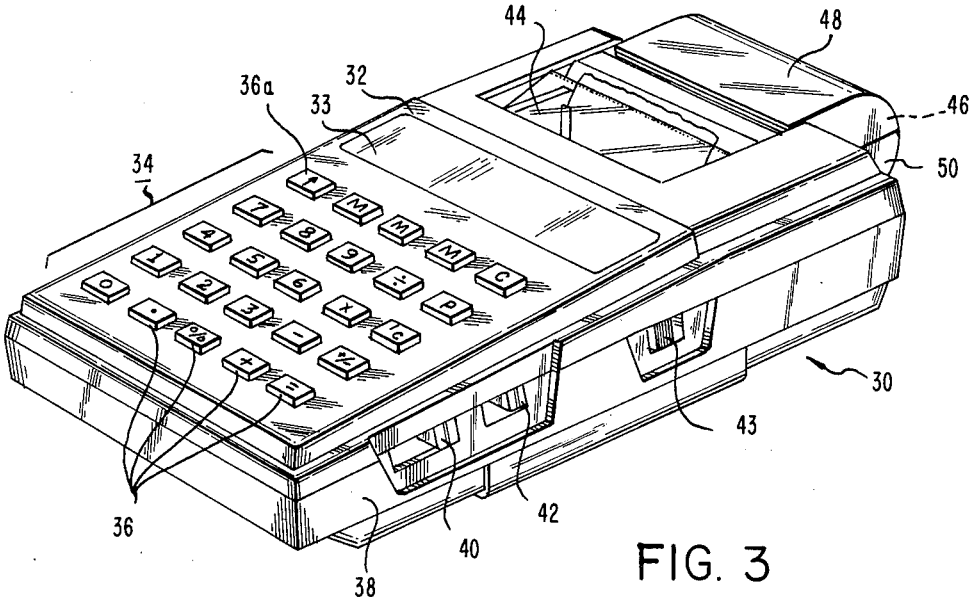
FIG. 3 shows in perspective a commercially available electronic calculator suitable for adaptation in accordance with the present invention.

Referring now to FIG. 3, an electronic printing calculator 30 is shown. Calculator 30 is of a standard commercially available type having a first surface 32 which contains a display window 33 for viewing digital characters, which may be an LED or LCD, and a keyboard 34 having thereon a plurality of numerical and functional command keys shown generally at 36 by which an operator can input information and commands into the calculator 30. One side surface 38 of calculator 30 contains additional command switches 40, 42 and 43, which operate functions such as power, print selection and decimal location.

As shown in FIG. 3, the rear portion of calculator 30 includes a printing mechanism 44 which will be described in greater detail hereinbelow and a paper accommodating chamber 46 which typically accommodates a roll of plain print-out paper 47 (FIG. 4) to be fed into the printing mechanism 44. Paper accommodating chamber 46 includes a removable cover 48 which is attached to a base portion 50 integrally formed with calculator 30.

The particular calculator shown by way of example is of the type marketed by Sharp Electronics Corporation, Paramus, N.J., under the trademark ELSIMATE, Model Number EL-1188S. This calculator is more fully described in one or more of the following U.S. Pat. Nos. 3,571,655; 3,834,616; 4,020,467; 3,902,169; 3,976,944 and 3,571,808. However, it is contemplated that any similar calculator having a printing mechanism can also be utilized in accordance with the present invention. Further, it is contemplated that calculator/computers having an alpha-numeric display and printout can also be used in accordance with the present invention.

A particular feature of the above described calculator is its capability to print and display more than one decimal point in a series of numbers in a single line. In most calculators, once the decimal command button is depressed in a given series of digits in the line, subsequent attempts to enter another decimal point in that series will be disregarded, and the next entered digit will be entered in juxtaposition with the last entered digit. However, in the above described calculator, upon each entering of a decimal point, a corresponding point will be entered in the series. Thus print-outs such as "1.2.3.4" and "12 . . . 34" are possible. As will be described hereinafter, this feature is particularly advantageous to the present invention.

Figure 4:
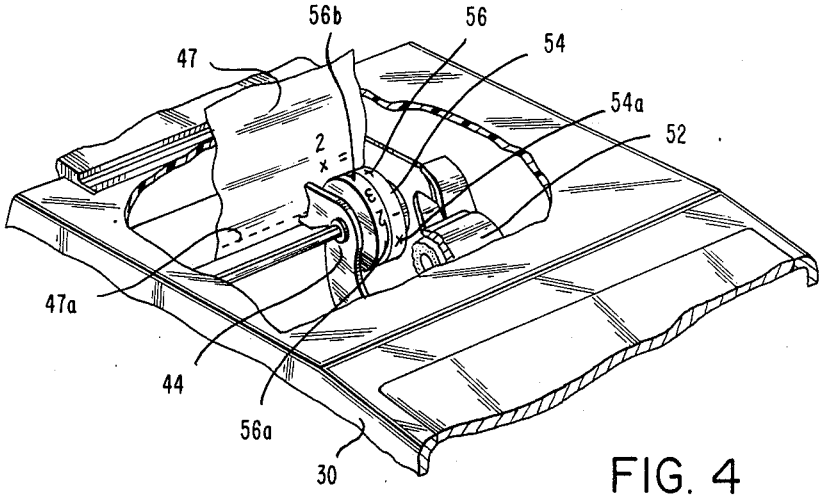
FIG. 4 is an enlarged, partially broken away, showing of the printing mechanism of the calculator shown in FIG. 3.

Referring now to FIG. 4, the printing mechanism 44 is shown in greater detail. Printing mechanism 44 includes an ink supply 52 which provides ink to a pair of rubber band-type printing wheels 54 and 56. The first wheel 54 includes thereon, raised characters 54*a* which form the functional identifying indicia on the print-out. This indicia identifies the mathematical operation or result such as "X" for multiplication and "T" for total, etc. As this functional indicia is not usually necessary in producing printed wire markers, this printing band may be removed by cutting the band from the wheel or similarly removing the wheel from the printer. The band of the second wheel 56 includes thereon raised characters 56*a* which form the digits on the print-out. Additionally, this wheel includes the above-mentioned decimal point character 56*b* which places the decimal point at one or more desired locations among the printed digits. In printing a wire marker, it may be preferable to provide one or more spaces between series of printed digits, such as, "12 34" or "1 2 3 4", etc. By removing the decimal point character 56*b* from wheel 56, a space will be printed each time the decimal point button 36 is depressed in a series of digits. The decimal point character can be removed by cutting or trimming the character 56*b* from the band of wheel 56.

Figure 5:
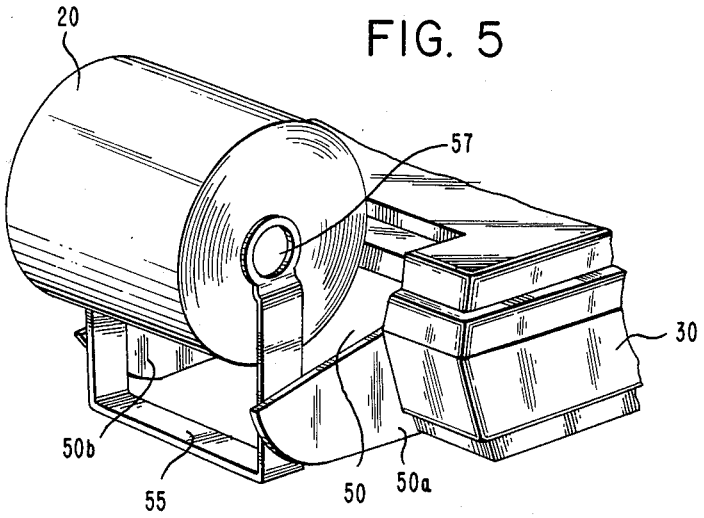
FIG. 5 is a rear perspective of the calculator of FIG. 3, partially broken away, showing the modified paper accommodating chamber of the present invention.

Referring now to FIG. 5, the rear portion of calculator 30 is shown modified in accordance with the present invention. In order to accommodate a roll 20 of wire markers 10, which is substantially larger than a roll of plain print-out paper, the paper accommodating chamber 46 is modified. Cover 48 (FIG. 3) is removed from chamber 46. A portion of base 50 is also removed, leaving a pair of opposed side walls 50*a* and 50*b* which form a bracing member to retain the wire marker roll 20. The roll 20 is mounted to side walls 50*a* and 50*b* by a U-shaped bracket 55 having a pair of opposed bossed engagement portions 57 at the upper end thereof. These opposed bossed portions 57 extend to resiliently engage either side of the core of roll 20 to rotatably secure the roll 20 in the bracket 55. The bracket 55 is attached to side walls 50*a* and 50*b* in a conventional manner and may be movably secured thereto. In the present embodiment as shown in FIG. 5, bracket 55 extends upwardly from side wall 50*a* and 50*b* to support roll 20 slightly above the upper surface of calculator 30. However, the roll may be secured at various positions adjacent the rear of calculator 30. Thus, for example, bracket 55 may extend longitudinally outwardly from the rear of calculator 30 to provide a lower profile for the assembled unit.

The free edge 20*a* (FIG. 2) of roll 20 can be inserted or fed into the printing mechanism 44 (FIG. 4) and will be in position to be printed, in the same manner as would be the print-out paper 47 conventionally used with calculators. It is apparent that in order to form a suitably printed wire marker, the indicia bearing portion 12 of wire marker 10 should be aligned with a printing reference point (shown at 47*a* of FIG. 4) of printing mechanism 44 along which the indicia is printed. One manner of aligning the indicia bearing portion 12 of wire marker 10 with the printing reference point 47*a* is to employ the paper advance mechanism (not shown) of calculator 30. The paper advance mechanism is activated by one of the functional keys 36*a* (FIG. 3) to advance the wire markers 10 beyond the reference point 47*a*. By controlling the advance of the roll 20 until the indicia bearing portion 12 is aligned with the printing reference point 47*a*, the indicia will be printed on the indicia bearing portion 12. Additionally, the wire markers 10 may be selectively positioned on roll 20 to provide synchronization between the number of depressions of functional advance key 36*a* and the distance advanced by roll 20. Thus, for example, every nine depressions of key 36*a* would result in a subsequent wire marker 10 having its indicia bearing portion 12 properly aligned with printing reference point 47*a*.

Referring again to FIG. 3 as above described, first surface 32 includes thereon a functional portion containing the keyboard 34 which is of a commercial variety containing the various operation command keys 36. As can be appreciated, by manipulation of selected keys 36, operational commands will be inputted into the calculator to perform various operations. As indicated hereinabove, in providing a wire marker printer in accordance with the invention, certain of these operations are not usually necessary, such operations including the calculation functions, operated by the arithmatic keys denoted as +, −, ×, ÷, and =. Similarly, other operations such as memory and percentage operated by their associated keys are also unnecessary. Therefore, the present invention contemplates rendering some or all of the keys 36 which operate these unnecessary functions, inoperative.

Figure 6:
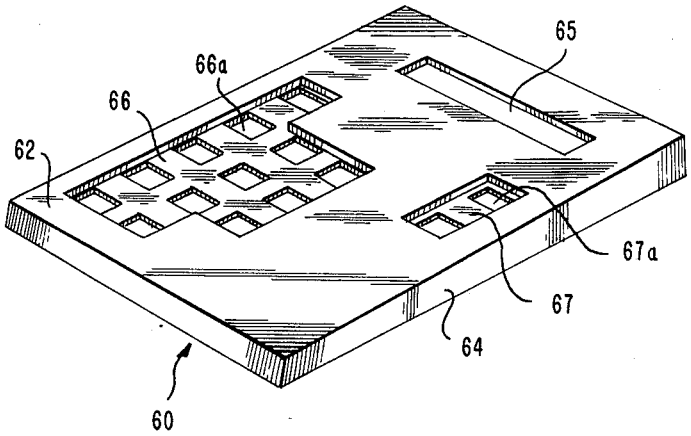
FIGS. 6 and 7 show in top perspective and side elevation views, respectively, a face plate constructed in accordance with the present invention.
Figure 7:
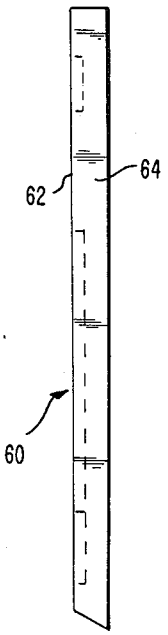

As shown in FIGS. 6 and 7, a cover or face plate 60 is provided which may be secured over the keyboard 34 and digital display window 33 (FIG. 8) and which only exposes those keys 36 which operate the selected functions. Face place 60 is a shell-type member having an upper flat surface 62 and depending side walls 64. Upper surface 62 includes recessed portions 66 and 67 thereon. Also included is a rectangular-shape opening 65 extending through cover 60 which permits exposure of the digital display window 33 of calculator 30. Recessed portions 66 and 67 include therethrough, a plurality of smaller openings 66*a* and 67*a* respectively, which permit exposure of selected ones of said command keys 36. The cover 60, when placed over the keyboard 34 of calculator 30 (FIG. 8), covers the keys 36 which operates the non-selected function. The keys 36 which operate the selected functions extend through opening 66*a* and 67*a* and may be freely depressed as required.

Figure 8:
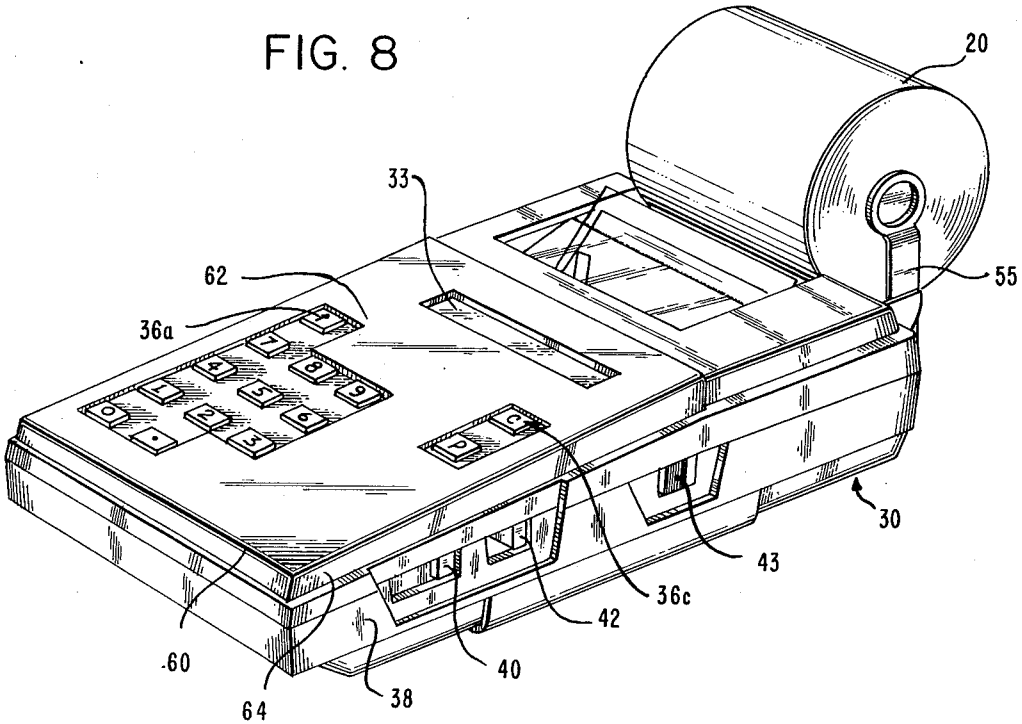
FIG. 8 shows in perspective, the calculator of FIG. 3 modified in accordance with the present invention to form a wire marker printer.

In the present embodiment cover 60 is formed of a rigid material such as plastic, however, any other suitably hard material such as metal may be employed. Positioned over keyboard 34 as shown in FIG. 8, side walls 64 extend above the height of the non-depressed keys 36. Thus, upper surface 62 will lie above keys 36 in a non-interfering position therewith and prevent access thereto. While the cover 60 itself provides sufficient protection to prevent the depression of the non-selected keys, the present invention contemplates additionally preventing the depression of the non-selected keys 36. The keys can be additionally de-activated by gluing or otherwise rendering the keys "frozen", or removing the keys entirely from the calculator.

A further modification of calculator 30 is also contemplated. As above described, the side surface 38 (FIGS. 3 and 8) includes a plurality of switches 40, 42, and 43 which operate additional functions. In the present embodiment, switch 40 operates the calculator decimal mode which varies the decimal placement or number of decimal places calculated, switch 42 activates the printing mode of the calculator 30 and switch 43 is the on/off power switch.

As the above invention contemplates use of the calculator 30 as a printer, it is preferable to maintain the calculator in the print mode at all times. Additionally, it is also preferable to maintain the decimal place mode in the "floating" mode to facilitate full use of the multiple decimal feature of the instant calculator, as above described. A permanent positioning member (not shown) may be inserted into the calculator between switches 40 and 42 to permanently set the switches at the selected positions and prevent the calculator from operating in other modes. The on/off switch 43 remains operable, thus enabling the user to turn the calculator off between uses.

Having modified the calculator 30 in accordance with the above, a wire marker may be formed as follows.

The wire marker roll 20 is attached to bracket 55 (FIG. 5) and is rotatably secured between bossed portions 57. The leading edge 20*a* of roll 20 is fed into the printing mechanism 44 (FIG. 4). The roll 20 is advanced until the upper edge of the first indica bearing portion is approximately aligned with the printing reference point 47*a*.

The desired indicia command keys 36 are then depressed, thus inputting the commands into the calculator 30. As described above, the commands can include any combination of digits or spaces (decimal points). The print command key 36*c* (FIG. 8) is then depressed, activating the printing mechanism 44 which will print the commanded indicia on the indicia bearing portion 12 of wire marker 10. Subsequent depression of the print command key 36*c* will again activate printing mechanism 44 and print the same indicia in a second row spaced below the first. Plural rows of printing may be desired on the wire marker, as the marker then can more easily be read without the need to rotate the wire.

The advance command key 36*a* is then depressed several times advancing the roll 20 to position the indicia bearing portion 12 of the next wire marker 10 with the printing reference point 47*a*.

Various other modifications to the foregoing disclosed embodiment will be evident to those skilled in the art. Thus, the particularly described preferred embodiment is intended to be illustrative and not limited thereto. The true scope of the invention is set forth in the following claims.

We claim:

1. In an electronic device having a keyboard defining a face and keys extending therefrom and a printing mechanism for printing indicia on an indicia receiving surface, a cover plate comprising a rigid member positionable over said keyboard said rigid member including means inclusive of opening for accommodating and permitting extention through said rigid member of selected ones of the keys of said calculator keyboard, said rigid member further including a first planar surface spaced from and overlying keys of said keyboard other than said selected keys for rendering said other keys inaccessable and thereby nonmanually operable and a second planar portion overlying said selected keys and including said openings therethrough, said second planar surface lying in a plane which is substantially parrallel to and spaced from the plane of said first planar surface.

2. A cover plate of claim 1 wherein said second planar surface defines a recessed portion of said rigid member.

3. A cover plate of claim 2 wherein said keys of said device extend above said face of said keyboard a given distance and wherein said first planar surface of said cover plate is supported spaced from said face surface of said keyboard a distance greater than said given distance and said second planar surface of said cover plate is supported spaced from said face surface of said keyboard a distance less than said given distance.

4. A cover plate of claim 3 wherein said rigid member further includes walls depending from said first planar surface to support said cover plate over said keyboard face surface.

5. A cover plate of claim 2 wherein said device includes a character display window and said first planar surface includes a second opening exposing said character display window.

6. A printing device comprising:

a keyboard having plural keys extending from said keyboard, said keys being depressible to trigger associated independent operational functions of a calculator, said keys of said device have extents thereof which lie in a plane spaced a given distance from said keyboard; and a cover plate including a generally rigid planar member having a first portion including a first planar surface supported in a plane spaced from said keyboard a distance less than said given distance, and having a plurality of openings therethrough for exposing selected keys of said device for direct manual depressible contact and including a second portion including a second planar surface overlying said keyboard adjacent said other keys having means for preventing said triggering of said operational functions of said printer associated with keys other than said selected keys, said first and second planar surfaces lying in substantially parallel, spaced nonintersecting planes.

7. A printing device of claim 6 wherein said second planar surface is supported in a plane spaced from said keyboard a distance greater than said given distance.

8. A printing device of claim 7 wherein said first planar surface defines an area recessed from said second planar surface.

* * * * *